US008898962B2

(12) United States Patent
Ingham et al.

(10) Patent No.: US 8,898,962 B2
(45) Date of Patent: Dec. 2, 2014

(54) BUILDING ROOF SYSTEM

(75) Inventors: Martin Ingham, Bolton (GB); Christopher Richardson, Lancashire (GB)

(73) Assignee: Martin Ingham, Bolton (GB)

( * ) Notice: Subject to any disclaimer, the term of this patent is extended or adjusted under 35 U.S.C. 154(b) by 0 days.

(21) Appl. No.: 12/855,278

(22) Filed: Aug. 12, 2010

(65) Prior Publication Data

US 2011/0197527 A1 Aug. 18, 2011

Related U.S. Application Data

(63) Continuation of application No. PCT/GB2009/000390, filed on Feb. 12, 2009.

(30) Foreign Application Priority Data

Feb. 12, 2008 (GB) ..... GB0802509.0
Jul. 5, 2008 (GB) ..... GB0812323.4

(51) Int. Cl.

| | |
|---|---|
| ***E04D 13/00*** | (2006.01) |
| ***E04B 7/20*** | (2006.01) |
| ***E04B 7/22*** | (2006.01) |
| ***E04D 3/35*** | (2006.01) |
| ***E04B 7/02*** | (2006.01) |

(52) U.S. Cl.

CPC . *E04B 7/022* (2013.01); *E04B 7/20* (2013.01); *E04B 7/22* (2013.01); *E04D 3/351* (2013.01)

USPC ..... 52/90.1; 52/11; 52/460; 52/578

(58) Field of Classification Search

CPC ..... E04B 1/70; E04B 7/00; E04B 7/022; E04B 7/20; E04B 7/22; E04C 2/20; E04D 1/00; E04D 3/351

USPC ..... 52/90.1, 456–461, 561, 578, 519–521, 52/542, 543, 545, 547

See application file for complete search history.

(56) References Cited

U.S. PATENT DOCUMENTS

| | | | | |
|---|---|---|---|---|
| 2,181,074 | A * | 11/1939 | Scott | 52/404.1 |
| 3,969,862 | A * | 7/1976 | Kuss | 52/404.1 |
| 4,463,533 | A * | 8/1984 | Mullet | 52/394 |
| 4,685,265 | A * | 8/1987 | Cooper | 52/277 |
| 2001/0020353 | A1 * | 9/2001 | Carr | 52/648.1 |
| 2004/0163328 | A1 | 8/2004 | Riley | |

(Continued)

FOREIGN PATENT DOCUMENTS

| | | |
|---|---|---|
| DE | 3626760 | 2/1988 |
| FR | 2506813 | 12/1982 |
| GB | 2364075 | 1/2002 |
| NL | 198103038 | 1/1983 |

(Continued)

*Primary Examiner* — William Gilbert
*Assistant Examiner* — Patrick Maestri
(74) *Attorney, Agent, or Firm* — Woodard, Emhardt, Moriarty, McNett & Henry LLP

(57) ABSTRACT

The invention relates to a roof structure which can be formed from a reduced number of components with respect to a conventional structure. The structure is typically pitched or sloped and comprises a series of spaced apart trusses which are spanned by roof panels which form the external face of the roof. The panels are interlinked or engaged and may in one embodiment be provided with an inner face of insulating material. In one embodiment the panels and/or other components, such as the trusses, may be formed from plastics material.

4 Claims, 10 Drawing Sheets

(56) References Cited

U.S. PATENT DOCUMENTS

| | | | | |
|---|---|---|---|---|
| 2004/0261336 | A1* | 12/2004 | Konstantin | 52/200 |
| 2005/0210761 | A1 | 9/2005 | Mower et al. | |
| 2007/0261340 | A1 | 11/2007 | Cecilio et al. | |

FOREIGN PATENT DOCUMENTS

| | | |
|---|---|---|
| WO | WO 80/00586 | 4/1980 |
| WO | WO 92/02696 | 2/1992 |
| WO | WO 98/37285 | 8/1998 |

* cited by examiner

BUILDING ROOF SYSTEM

This application is a continuation of PCT/GB2009/000390, filed 12 Feb. 2009, which is hereby incorporated by reference. This application claims priority from Patent Application No. GB 0802509.0, filed 12 Feb. 2008, which is hereby incorporated by reference and this application claims priority from Patent Application No. GB 0812323.4, filed 5 Jul. 2008, which is hereby incorporated by reference.

BACKGROUND OF THE INVENTION

1. Field of the Invention

The invention to which this application relates is an improved roof system for a building, such as, but not exclusively, a roof of a domestic premises.

2. Description of the Prior Art

There are many different types of roof systems currently used and the type of system to which this invention is directed, is that which comprises a series of trusses which are joined together to form a double or single pitched roof. The external roof surface is then defined by a series of tiles which are interlocked to form a roof which allows the drainage of rainwater therefrom into gutters.

While there are many different variations of this type of conventional roof system, they all typically comprise roof trusses which are made from wood, wall panels which can be made from wood or other fibre sheet material such as MDF, and tiles which can be manufactured from stone, such as slate, or composite materials such as, for example, clay and, in which case, the composite material is formed into a particular shape to aid interlocking and/or drainage.

Conventionally, wooden trusses are provided to run along a vertical axis from the top of the pitched roof to the bottom of the same and the wooden battens are provided to run along a horizontal axis spanning across the trusses. The tiles are provided with support means or engagement means which pass through the same so that each tile is provided to be located on at least one batten. Typically the tiles are of a width such that a number of the same are required to be placed side by side along the horizontal axis to span the distance between the trusses. It will therefore be appreciated that a large number of tiles are required to form the roof and that each of the tiles is required to be individually fitted in position.

A problem which is experienced with the materials used for conventional systems, is that the raw materials are increasingly expensive and also, on occasion, it can be difficult to manufacture the products to the required consistency and quality.

A further problem with the conventional roofing systems is that the same are constructed from components which are typically required to be sourced and supplied from a number of different organisations and locations. This can lead to incorrect ordering, time delays and general frustration during the construction process.

A further problem which exists with conventional roof systems is that they are heavy and therefore represent a significant part of the overall weight of the building. This is in turn means that the foundations required to support the building are required to be of significant depth which increases the cost of the building in terms of materials used and labour costs.

A yet further problem is the increasing requirement to be able to provide increased insulation materials in buildings in an efficient manner so as improve the efficiency of the building.

SUMMARY OF THE INVENTION

An aim of the present invention is therefore to provide components for a roof system which are manufactured and provided in a particular form so as to provide efficiency, consistency of manufacture and also to be of economic benefit and reduce the number of different components required to form the roof. A further aim of the invention is to provide a roof system which utilises components which, in conjunction, provide a system which is consistent in terms of quality and can have an increased life span and overcome or reduce the problems indicated above. A further aim is to provide a system which allows the ability for the components of the system to be provided from a reduced number, or single, supplier and location.

In a first aspect of the invention there is provided a roof system, said system comprising a plurality of trusses, each of the trusses lying along a respective substantially vertical axis, and said trusses spaced apart along the width of the roof to be formed, wherein said trusses are overlaid by a plurality of panels to form the external face of the roof, and said panels are of a width so as to span the gap between at least two adjacent trusses with the interfaces between respective panels located to overlie a truss.

In one embodiment the panels are provided so as to span two or more gaps between trusses. Typically the panels are formed such that a portion adjacent each vertical edge of the panels overlies at least part of a truss.

In one embodiment the panels have vertical and horizontal interfaces with adjacent panels, and at least the horizontal interface one of the panels is provided with a lip portion which overlies the adjacent panel.

Typically the interfaces between adjacent panels are provided so as to allow a degree of thermal expansion of the panels to be accommodated.

In one embodiment the support members are provided at the interfaces to underlie the same.

In one embodiment the components of the system are manufactured from plastics material. In one embodiment the panels include a layer of insulating material, said material preferably formed integrally with the panels under factory conditions. In one embodiment the insulation material is attached to the tile. In one embodiment the layer of insulation material is formed on the inner facing surface of the tile. In one embodiment further layers of insulating material can be provided within the roof system and lying between the inner surface of the tile and the ceiling of the room below. The provision of the layer of insulation with the panels or tiles means that insulation is not required to be provided separately in the roof space. This, in turn, means that the amount of available roof space to be used for other purposes is increased with regard to the conventional roof systems.

In one embodiment the panels are provided with preformed engagement means formed in the edge wall thereof such that a first wall has a first formation located thereon, a second opposing wall has a second formation located thereon and when said first and second edges of first and second panels are brought together engagement of the panels together can be achieved. In one embodiment the engagement is achieved by a relative pivotal movement between the panels edges.

In an alternative embodiment the system incorporates engagement means which are located to engage the adjacent panels together at the interface and/or said panels with the underlying truss or support member.

In one embodiment the engagement means are located on the truss via a first arm, said arm connected to second and third arms which oppose each other and which arms engage, respectively, with the edges of panels brought into an abutting relationship therewith.

In one embodiment the engagement means are provided with a rebated section which can act as a channel along which fluid can flow to be drained. Typically matching rebates are provided in adjacent panel edges with the rebates provided of a form so as to have sufficient tolerance to allow efficient and accurate site installation.

In one embodiment cover means are provided to be located over the interface between respective panels and to act as a means to prevent the ingress of moisture into the interface. In one embodiment the cover means can be moved into and retained in position with respect to the panels by a snap fit action.

Typically the tiles are located directly on the roof trusses thereby meaning that the conventional use of battens between the trusses is not required, and thereby reducing the number of different components and amount of materials which are required to be used.

Preferably, the roof trusses, and roof tiles, are manufactured from plastics material. In one embodiment, the plastics material which is used, is PVC although it is envisaged that other plastic materials or composite mixtures can be used. In certain embodiments, different plastic materials may be used to form different components.

In one embodiment, the roof trusses which are used, are formed to a required length or alternatively, may be continuously formed and then subsequently cut to a required length to suit particular roof system designs.

In one embodiment, the roof trusses are manufactured by extrusion moulding and may be delivered on site in uniform lengths for subsequent cutting to the required length. Alternatively, the same can be cut to the required length at the location of manufacture and then transported for the formation of a particular roof system.

In one embodiment, location means may be formed in the components at the time of manufacture or may be formed subsequently at the location of construction of the roof system.

Typically, many of the roof panels in the roof system, are provided of the same design and said design includes a female engagement means and a male engagement formation, typically formed at opposing edges of said roof panel. The female engagement formation is provided to receive a male engagement formation of an adjacent roof panel, when positioned on the roof, to thereby allow adjacent roof panels to be interlocked.

Typically, on the inner face of the panel, there is provided at least one location formation, said formation formed to allow the same to engage with one of the trusses and thereby support the panel in position on the truss.

In one embodiment the location formation is an elongate groove.

In one embodiment the boards used to form the ceiling are attached to the underside of the trusses.

In one embodiment, the roof panels can be provided with, along certain edges, sealing formations or alternatively, when fitted in position on the roof system, sealing means are located between the adjacent panels.

In one embodiment, the sealing means comprise a plurality of strips which are spaced apart across the depth of the roof panel to thereby prevent the ingress of water between the roof panels.

In one embodiment, the roof system includes wall plates, which depend downwardly from the location of the ends of the roof trusses and the top face of the wall which support the roof system. Typically, these wall plates are also made of plastics material.

The trusses are respectively joined together to form the roof frame using gusset plates, which may be manufactured from plastics or more typically, metal.

If required, noggins are provided between rafter members of the roof which can be manufactured from plastics material and any packing members can also, if required, be manufactured from plastics material.

Typically, at the peak of the roof, if required, ridge tiles can be located, said ridge tiles can also be formed of plastics material.

It will be appreciated that in accordance with the invention, there is provided a roof system which can be mainly or indeed wholly formed of components formed of plastics material, with the plastics material being formed into the required components, with significantly tighter tolerances than the conventional materials used to form said components.

It should also be appreciated that each of the components herein described, can be used independently, in a roof system, in which the other components may not necessarily be manufactured from the plastics material.

The invention is particularly of use with regard to a roof system according which is pitched or sloped.

In a further aspect of the invention, there is provided a roof system, said roof system including a series of trusses, interconnected to form a roof frame, and a plurality of roof panels or tiles, supported by said roof trusses, and wherein any one or combination of the roof trusses and/or roof panels or tiles, are manufactured from a plastics material.

In a further aspect of the invention, there is provided a roof panel or tile, said roof panel or tile manufactured from plastics material and having at one edge, a male location member formed therein and, at the opposing edge, a female engagement means formed therein, said male and female engagement means provided to interlock with respective male and female engagement means on adjacent roof panels or tiles when placed together in appropriate orientation as part of a roof.

In one embodiment the external face of the roof panel is provided with one or more markings to give the visual appearance that the panel is formed of a plurality of smaller conventional tiles.

In one embodiment at least the surface of the panel which faces inwardly when fitted includes or is formed by a layer of insulating material.

In a further aspect of the invention, there is provided a roof system comprising trusses and roof tiles, and wherein the trusses at least are formed of plastics material.

BRIEF DESCRIPTION OF THE DRAWINGS

Specific embodiments of the invention are now described, wherein:—

DESCRIPTION OF THE PREFERRED EMBODIMENT

Figure 1:
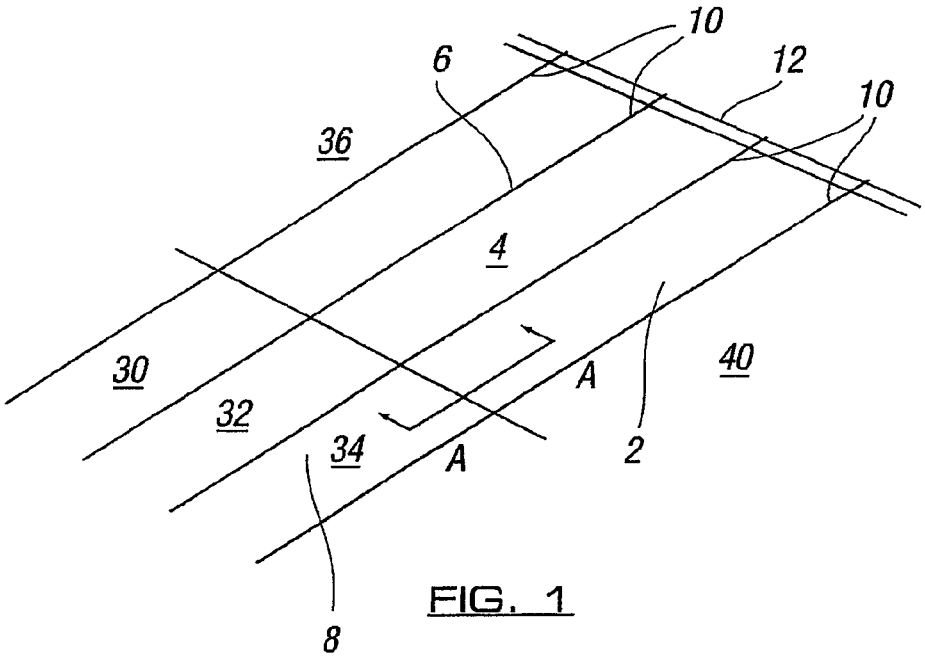
FIG. 1 illustrates part of a roofing system formed in accordance with one preferred embodiment of the invention.

Referring firstly to FIG. 1 there is illustrated a view of part of a sloped roof 2 which has an external face 4 formed from a plurality of panels 6, 8.

Figure 2:
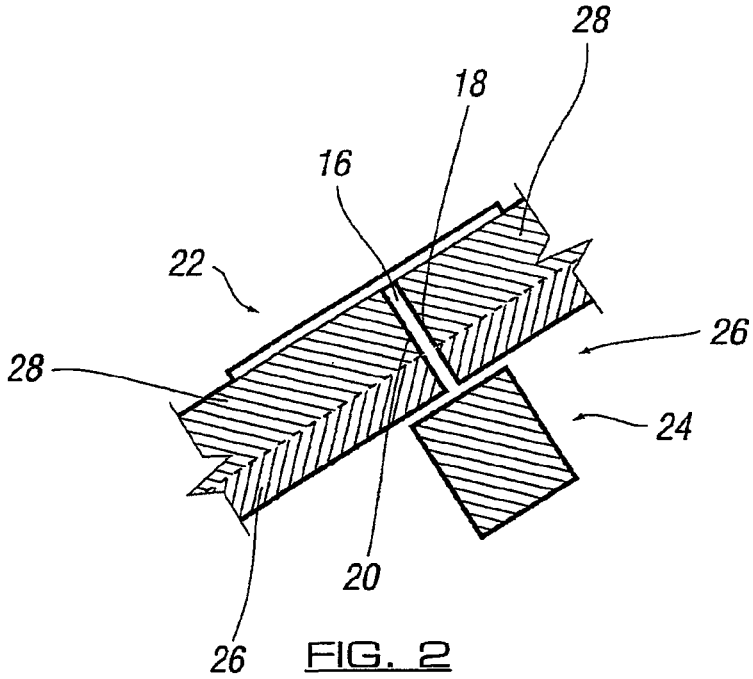
FIG. 2 illustrates a sectional view on line AA of an interface of part of the roofing system of FIG. 1.

The panels are supported on a series of spaced apart trusses 10, shown in broken lines and which run from the ridge 12 of the roof down to the lower edge. The panels are provided with horizontal interfaces 16 with adjacent panels and one of these is shown in more detail in FIG. 2.

In this case the interface between the respective edges 18, 20 of panels 6,8 is provided with a lip portion 22 which is formed on the edge 18 of the upper panel and hence masks the interface from moisture. A lower support member 24 is also shown which can be provided to lie in a substantially horizontal plane and these support members can be positioned to underlie the interface. The underside of the panels can be formed with a layer of insulating material 26. The topside 28 of the panels can be made from plastics material.

The panels can be made of a width to suit specific requirements and typically will be of a width so as to span the gap 30 between adjacent trusses as shown in FIG. 1. However the panels may be made wider such that they also span the gap 32 or gap 34 between four trusses as shown. In one embodiment the lengths of the panels 36 can be in metres such as 6-8 metres lengths. However, in whichever embodiment, the interfaces between adjacent panels are formed so as to allow expansion due to environmental conditions to be taken into account.

Figure 3:
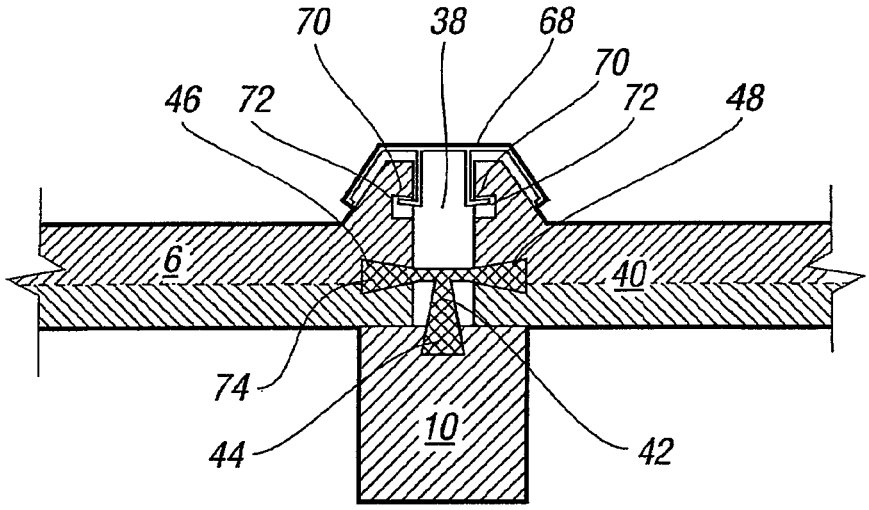
FIG. 3 illustrates a cross section of a roofing system of the invention showing the interface between adjacent panels.
Figure 4:
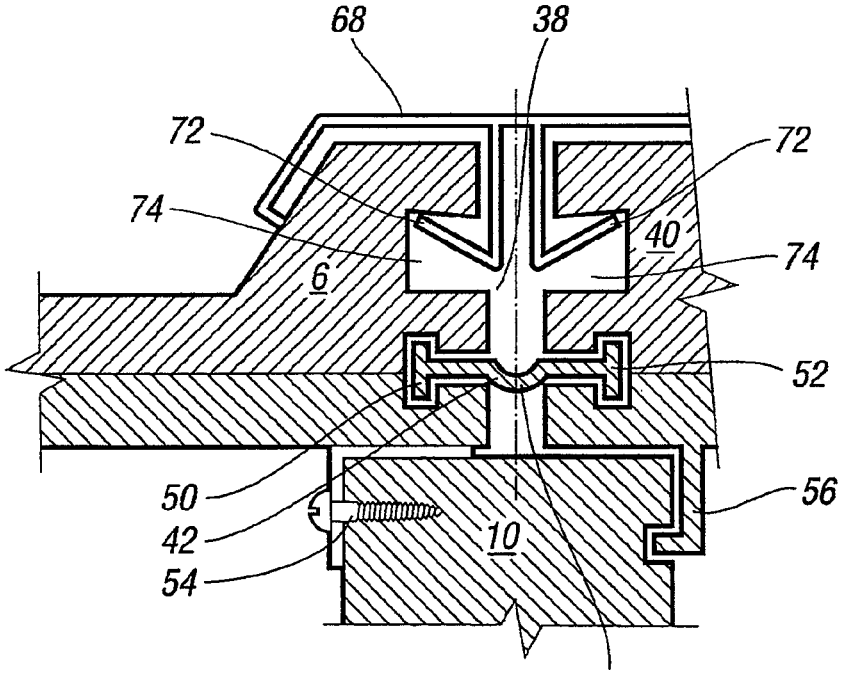
FIG. 4 illustrates a cross section of a roofing system of the invention showing the interface with an alternative form of engagement means used.
Figure 5:
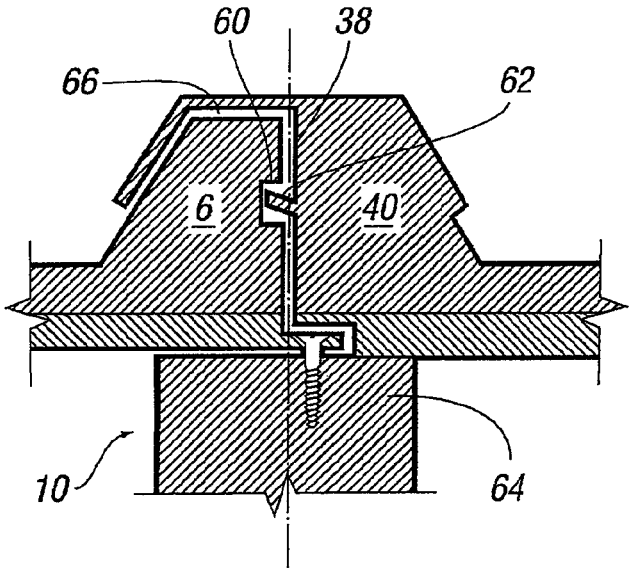
FIG. 5 illustrates a yet further cross section showing the interface between adjacent panels.

Turning now to FIGS. 3-5 the interface between the panel edges which lie in the vertical plane are shown. The panels are formed and located such that the interface 38 lies on a truss 10 as shown in each case and as a result a portion of the panels on each side of the interface 38 overlie and are supported by a truss.

The panels shown are panel 6 from FIG. 1 and a panel 40 to the right hand side of the same as looking at FIG. 1.

Referring firstly to FIG. 3 there is shown an interface 38 with engagement means 42 in a first embodiment. The engagement means have a first arm 44 received by the truss 10, and second and third arms 46, 48 which are received by the edges of the panels 6 and 40 respectively in a dovetail slot arrangement formed in each of the panels edges and the truss. Alternatively the first arm and indeed the engagement means may be provided as an integral part of the truss such that the edges of the panels can be slid along the same to form the interface 38. Yet further the engagement means can be formed as an integral part of the edge of one of the panels. As well as the engagement means providing mechanical engagement between the panels, it also provides a secondary seal at the interface.

FIG. 4 illustrates a further arrangement in which in this case the engagement means at the interface is formed by two arms 50, 52 which are received in the respective edges of the panels 6, 40 in slots formed therein. Additional engagement with the truss 10 can be achieved using screws 54 and/or hook portions 56 so as to secure the panels to the truss.

Turning now to FIG. 5 there is illustrated a further engagement means arrangement in which the adjacent edges of the panels can be joined together without the provision of separate engagement means but by using formations 60, 62 integrally provided on the panels edges themselves. In this case a pivoting action between the panels allows the locking engagement of the panels. Additional securing means 64 can be used to secure one of the panels to the truss 10. In this arrangement one of the panels 40 is provided with an overlapping formation 66 which acts as a cover for the interface 38.

In FIGS. 3 and 4 a cover means 68 is provided which has clip features 70 to be received in formations 72 on the edges of panels 6, 40 so as to allow the cover to be retained in position and hence protect the interface 38 from the ingress of water.

Furthermore in both FIGS. 3 and 4 the top face can be formed so as to act as a secondary drainage channel 74 along which water can be drained. In FIG. 5 the hook formation 62 can be used as a drainage channel.

Figure 6:
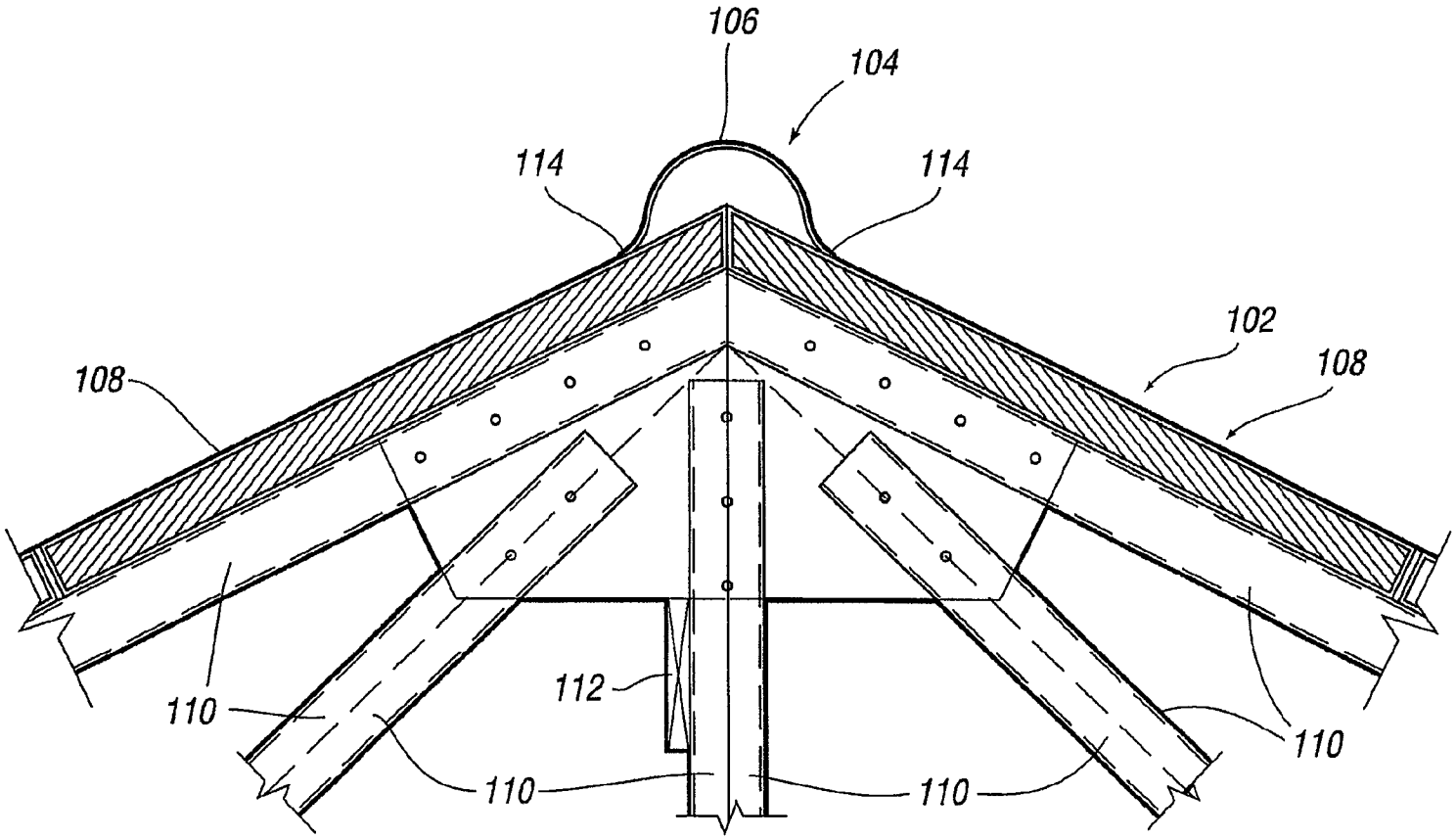
FIG. 6 illustrates a cross sectional view of a roof system in accordance with the invention in a further embodiment.
Figure 7:
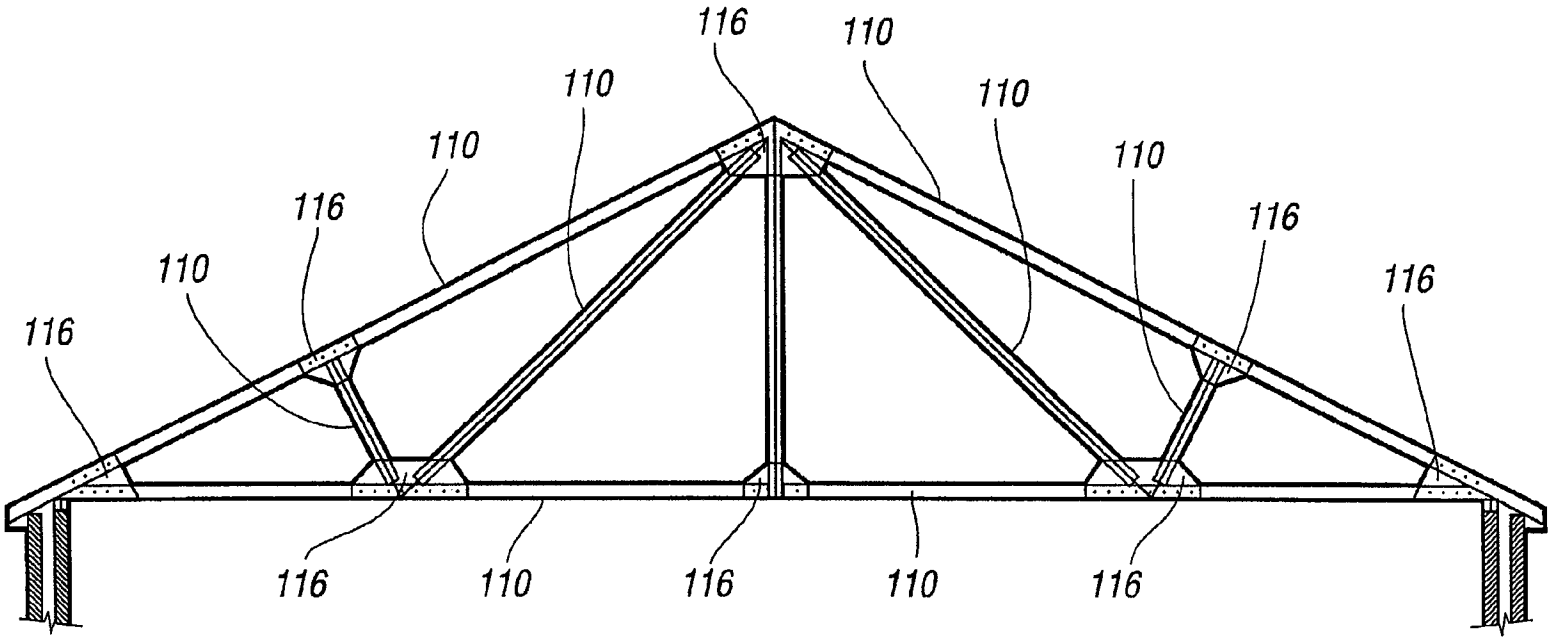
FIG. 7 illustrates a frame of the roof system of FIG. 6.
Figure 8:
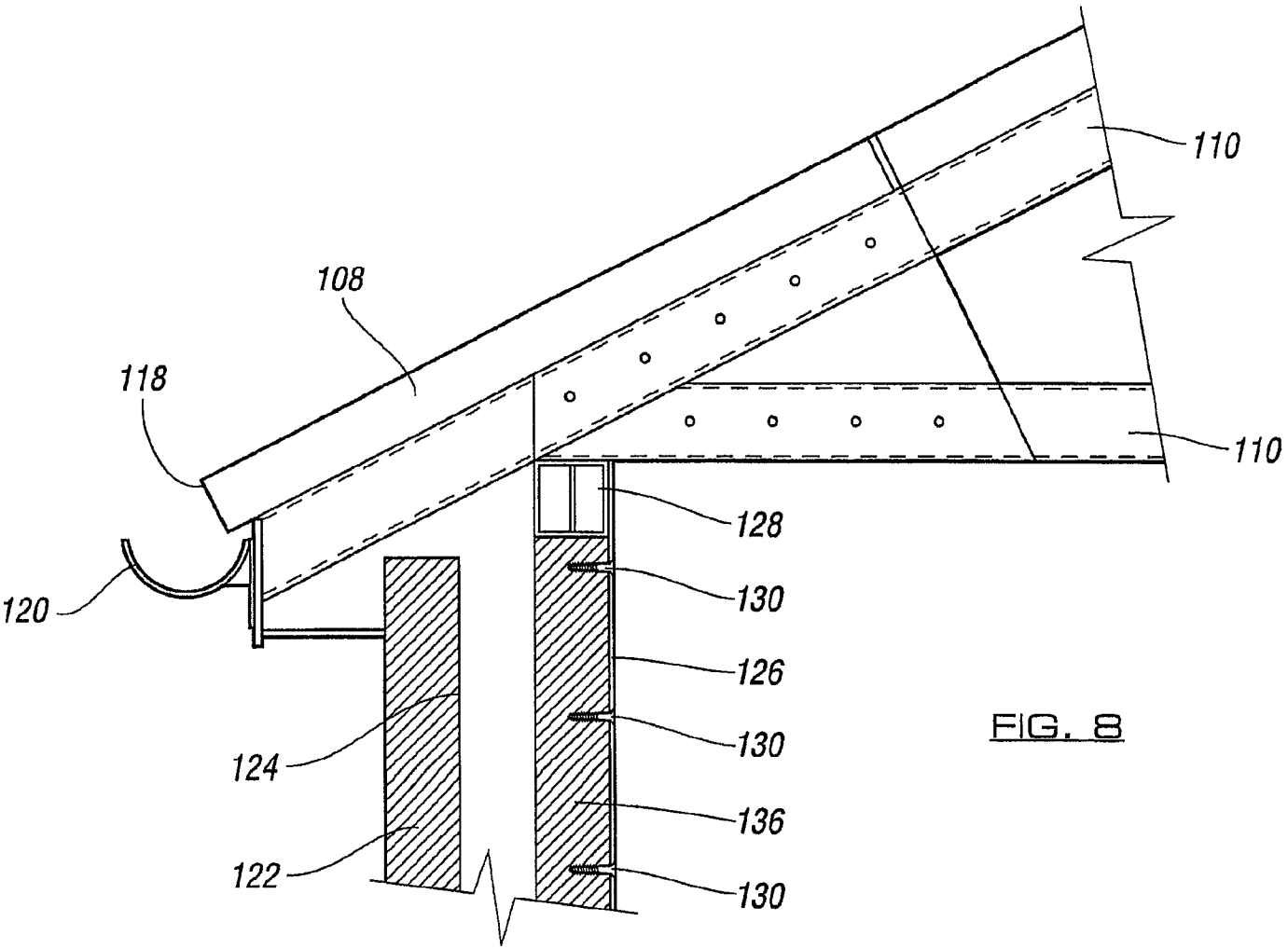
FIG. 8 illustrates the cross section detail of the eaves of the roof of the embodiment of FIG. 6.

Referring now to the embodiment of FIGS. 6, 7 and 8, there are shown various features of a first type of roof system 102 for a ridge roof. FIG. 6 illustrates an assembly of the ridge 104 of the roof system 102 in cross section and shows the ridge tiles 106 which pass along the ridge 104, and depending downwardly therefrom on either side, roof panels 108. The roof panels are supported on a roof frame formed of a series of truss members 110 and, if required, additional longitudinal ties 112 can be provided to add to the stability of the roof system. In this case, each of the components of the roof, ridge tiles 106, roof panels 108 and trusses 110, are formed from plastics, typically PVC, material and therefore there is no wood or other materials used in the roof system.

The ridge tile is secured in place on the roof panels 108 by using a pre-formed fixing 114 formed in the roof panels 108 which are to be used for the ridge and a rubber seal can be provided at that location so as to provide the seal between the ridge tile and the roof tile.

FIG. 7 illustrates the frame of the roof system 102 in more detail, with the tiles removed, thereby showing the roof frame manufactured by the joining together of a series of the plastic truss members 110. It should be appreciated that the truss members can be provided as a series of uniform lengths, which are then cut to a suitable length at the location of manufacture of the roof frame. Alternatively, the truss members can be formed to the required length, at the factory to suit a particular order. The respective ends of the trusses 110 are joined to other trusses using plates 116 which, in this case, are of metal.

FIG. 8 illustrates a more detailed view of the eaves of the roof system 102 and shows the roof panels 108 depending downwardly such that the free edge 118 of the same leads into the gutter, facia and soffit assembly 120 which can also be manufactured of plastics material. The roof system is supported on the walls of the building, one of which 122 is shown and which comprises a cavity wall arrangement 124 and inner wall plate 126 which can be manufactured from plastics material such as PVC and which acts to support, at the top end 128, the roof frame formed by the trusses 110. Typically, the wall plate 126 is strapped to the inner block work 136 by a series of straps 130 as shown.

Figure 9:
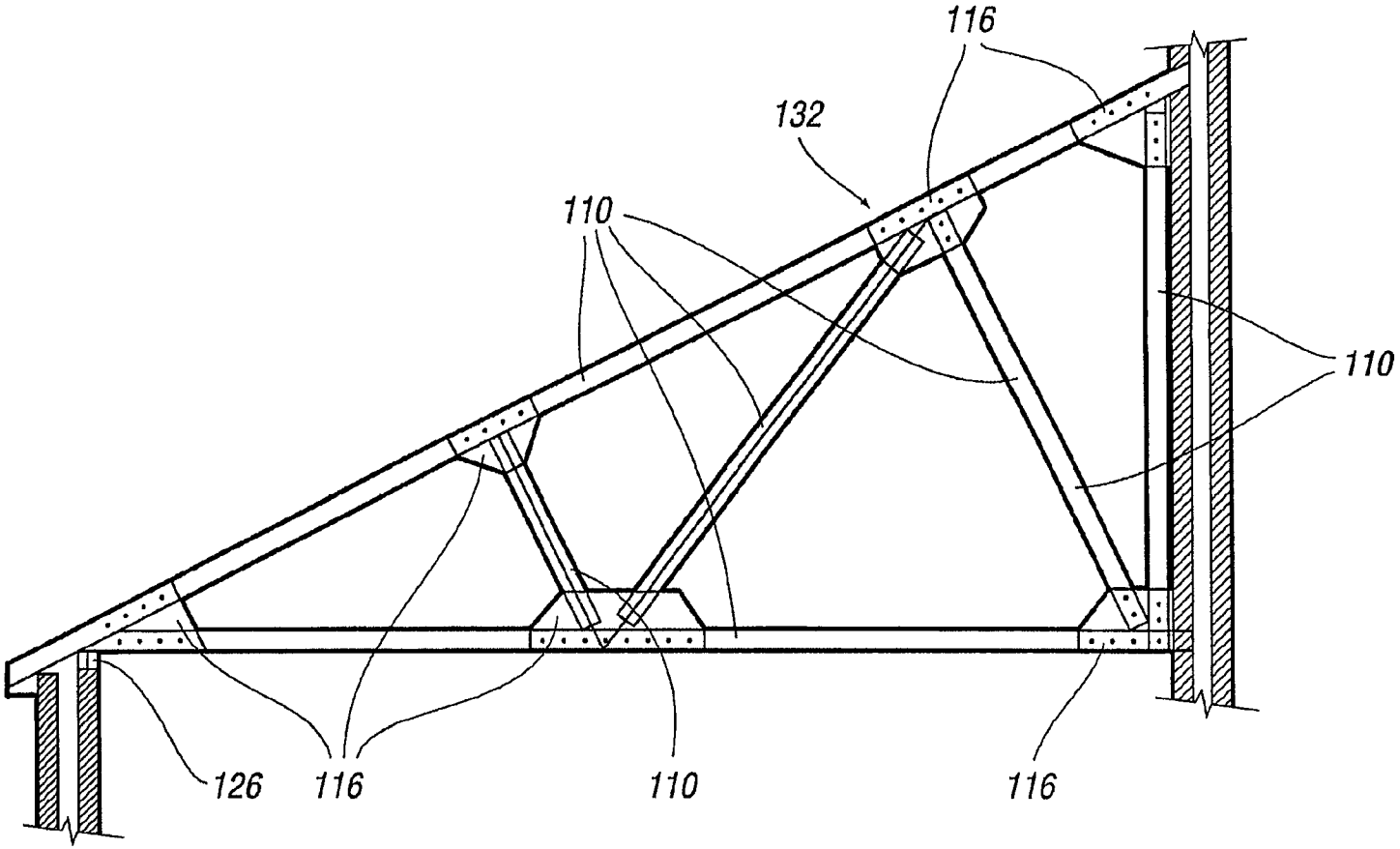
FIG. 9 illustrates a further embodiment of the invention in the form of a frame for a mono-pitched root.
Figure 10:
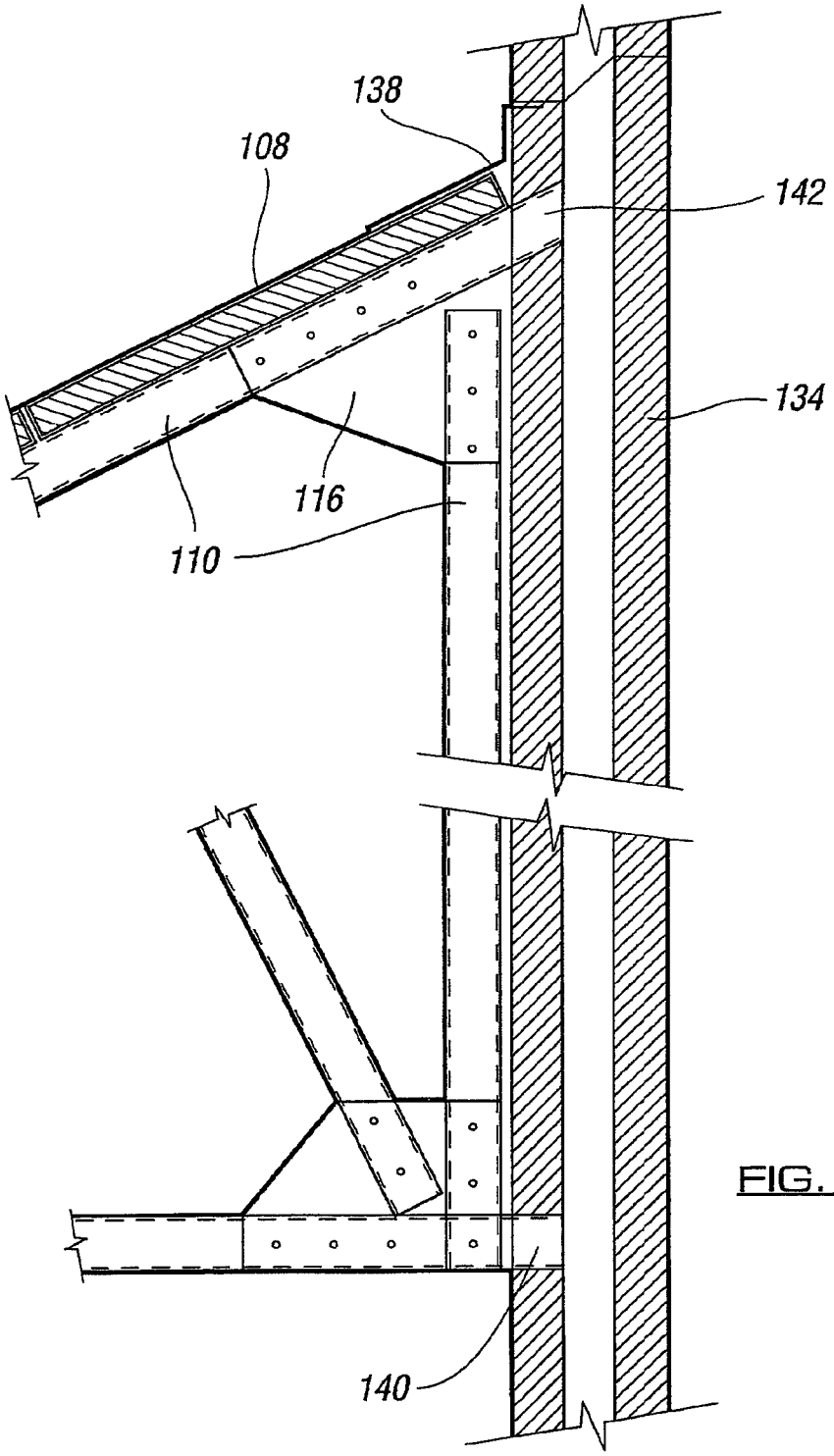
FIG. 10 illustrates a cross section detail of a roof system of FIG. 9.

FIGS. 9 and 10, illustrate an alternative roof system for a mono-pitched roof 132 FIG. 9 illustrates the roof frame formed by a series of the truss members 110 and metal plates 116 which join the same together. A wall plate 126 is provided at one edge and again the wall plates and trusses can be formed of PVC material. As shown in FIG. 10, the roof panels 108 are supported on the trusses 110 of plastics material and, at the interface between the roof panels and the wall 134, there is provided flashing 138 to provide a watertight seal between the top of the roof panel 108 and the inner face of the wall 134. At the bottom of the roof frame the end 140 of the truss member 110 can be built into the cavity wall 134 as illustrated to provide additional support and this is repeated with the end 142 of the truss member 110 at the top of the roof.

Figure 11:
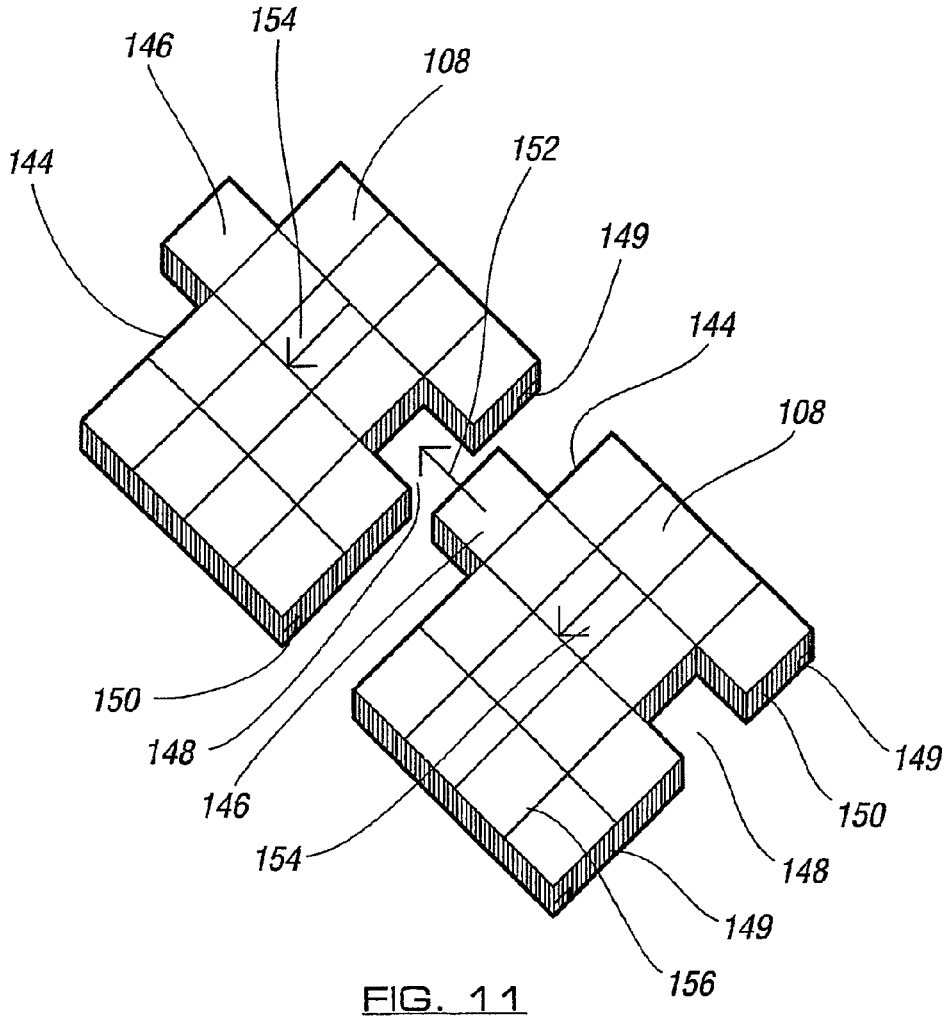
FIG. 11 illustrates one embodiment of roof panels or tiles in accordance with the invention.

Turning now to FIG. 11, there are illustrated two roof panels 108, in accordance with the invention, each manufactured from plastics material and which can be provided, as required, with an inner facing surface formed of insulating material to thereby provide an insulating effect.

Each tile is provided with a male engagement formation 146 on edge 144 and a female engagement formation 148 on edge 150. These respective engagement formations, are provided to interlock as indicated by the arrow 152 when the panels are placed in position on the roof with the edges 144 and 150 being positioned parallel with the direction of slope 154 of the roof. The panels can also be provided with a location groove 149 which runs along the width of the panel and allows the tile to be located on an underlying truss.

A further important feature of the invention with regard to the roof panels is that the same can be provided with lines of detail 156 on the external face which allow the external face of the panel to have a visual appearance of a series of smaller tiles, in this case 16 tiles, to give the visual appearance of 16 tiles being used to cover the area which is in fact covered by only one panel 108 thereby providing the finished roof with a more traditional visual appearance.

Figure 12:
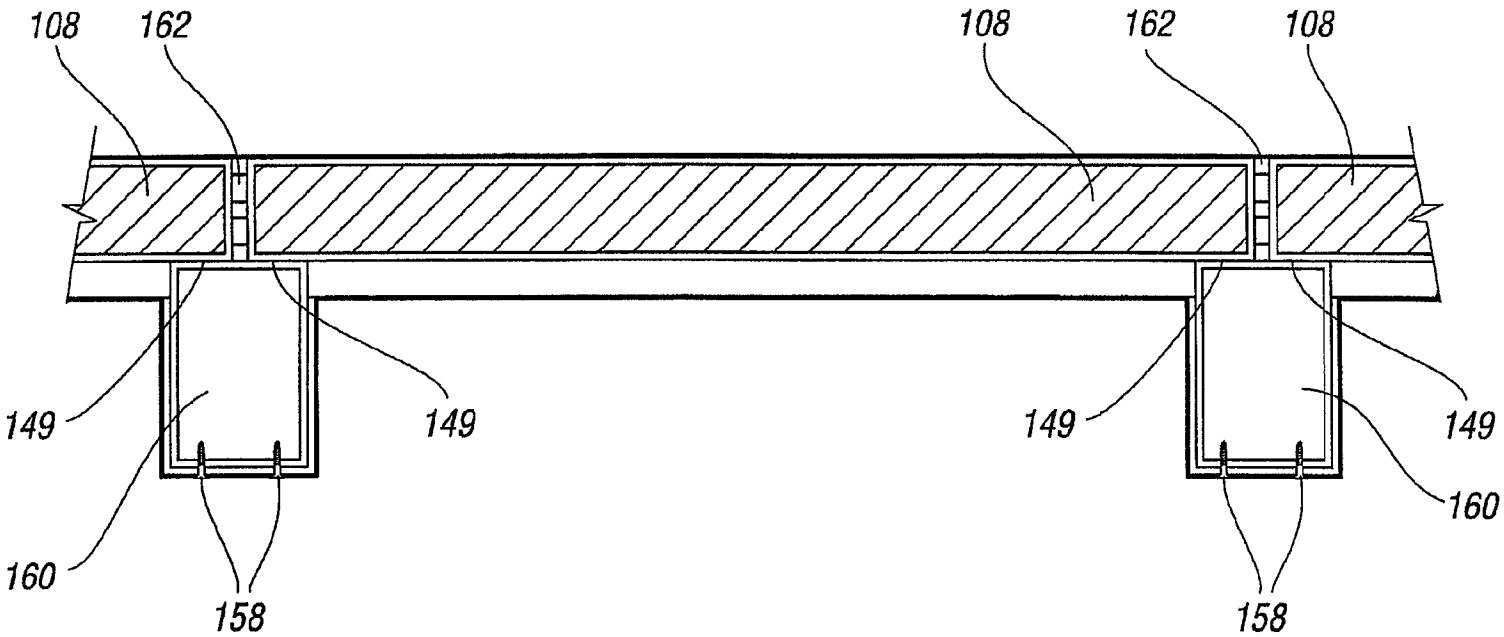
FIG. 12 illustrates one embodiment of joining the tiles of FIG. 11 in accordance with the invention.

FIG. 12 illustrates the manner in which adjacent roof panels can be joined together and joined to the roof trusses 110, although it should be noticed that the slope of the roof is not shown in this view for ease of illustration. The panels can be recessed at the trusses so as to allow the same to be clipped to the trusses using a fixing 158 which leads to the panels and thereby secures the panels to the underside of the trusses 160 and an inner layer of insulating material formed in one embodiment as part of the panel or alternatively attached thereto, when provided, can be recessed so as to be positionable between the trusses when the panels are in position. It will also be appreciated that further layers of insulating material can be positioned between the panels and the boards which form the ceiling of the room below thereby further improving the insulation properties achieved.

Rubber seals 162 which in this case comprise three linear seals, can be positioned between the adjacent panels as shown, so as to prevent the ingress of moisture through the gaps between the adjacent panels.

If required, additional materials can be added to the roof panels to provide a particular finish and/or to improve the life of the same.

The system of the invention allows the removal of excessive skills and steps which are conventionally required to form a roof structure. This is achieved by the development of a system which allows integrated insulation to be provided, which removes the need for sarking felt and battens to be used. The system can be used with kits manufactured under factory conditions which reduces time of construction on site and allows the components to be manufactured in controlled environments. The system can also be adapted to provide additional usable space within the roof and for built in roof lights to be provided as an option.

The components can be made from a range of selected material. For example, the trusses can be manufactured from materials which are suitable with regard to the span of the roof to be formed, the space required under the roof and the materials can be a selection or combination of wood, plastics and/or metal.

The panels can be moulded from plastics material, foam or the like and may be made as a solid item or with channels and/or pockets in which insulating material can be located.

The present invention therefore provides a roof system which can be utilised to significant benefit both in the construction of the same and with regard to the finished roof. Thus, in contrast with conventional systems there is provided a roofing system which facilitates the interconnection of adjacent panels directly and also onto the underlying truss at the interface between panel edges which removes the need for cross purlins or beams which would conventionally be used for attachment of large industrial panels and battens which would be used for attachment of slates or tiles.

Thus, there is provided in accordance with the invention, a roof system, and components therefore, which are manufactured from plastics material rather than conventional materials and which as shown in the accompanying figures, can be utilised together, in conjunction, to form a roof system which can efficiently be manufactured and constructed. Furthermore a reduced number of components and materials may be used such as the fact that battens are not required to be used and the roof system can have improved insulation by providing the tiles with insulating characteristics. This is in addition to the fact that due to the structure and components and materials used, the overall weight of the roof system in accordance with the invention is significantly lighter than conventional roofs for the same building. This therefore means that the overall building is lighter and hence the foundations which are required for the building can be reduced in size and/or depth in comparison to those required for the equivalent conventional building. It will therefore be appreciated that the direct benefits with respect to the roof also provide further benefits in the overall building construction. Furthermore in many cases the visual appearance and life of the roof system which is created is also improved.

The invention claimed is:

1. A roof system, the components of the system manufactured from plastics material, said system comprising a plurality of trusses, each of the trusses lying along a respective substantially vertical axis, and said trusses spaced apart along the width of the roof to be formed, wherein said trusses are overlaid by a plurality of adjacent panels to form the external face of the roof, and said panels are of a width so as to span the gap between at least two adjacent trusses with the vertical interfaces between adjacent panels located to overlie a truss forming a channel between adjacent panels, said panels have mutually facing panel edge surfaces, said mutually facing panel edge surfaces having a first pair of mutually facing slots opening toward each other into said channel and a second pair of mutually facing slots opening toward each other into said channel; and one or more cover means (68) configured to prevent the ingress of moisture into the interface are provided to be located over the vertical interface between respective panels, wherein said cover means are retained in position by clip features (70) that extend between said panels in said channel and into said first pair of mutually facing slots (72) formed in the mutually facing panel edge surfaces in the channel between the panels and at least part of the cover means clip features are received in substantially horizontal formations of the first pair of mutually facing slots formed in the mutually facing panel edge surface panels; and, engagement means (40) with a pair of oppositely projecting arms (46) and (48) extending between said panels and into said second pair of mutually facing slots in the mutually facing panel edge surfaces.

2. A system according to claim 1 wherein the system incorporates an engagement means configured to engage the adjacent panels together at the interface and/or said panels with the underlying truss or support member;

the engagement means are located on the truss via a first arm, said arm connected to second and third arms which oppose each other and which arms engage, respectively, with the edges of panels brought into an abutting relationship therewith.

3. A system according to claim 2 wherein the engagement means are provided with a rebated section which can act as a channel along which fluid can flow to be drained.

4. A system according to claim 2 further comprising ridge tiles and/or flashing configured to prevent the ingress of moisture, said ridge tiles secured in place on said panels using pre-formed fixings formed in said roof panels.

* * * * *